United States Patent [19]

Reeve-Parker

[11] Patent Number: 4,861,370

[45] Date of Patent: Aug. 29, 1989

[54] PROCESS FOR TREATING MOLTEN ALUMINUM ALLOY WITH POWDERED FLUX

[75] Inventor: Michael C. Reeve-Parker, Kidderminster, England

[73] Assignee: Ashland Oil, Inc., Russell, Ky.

[21] Appl. No.: 275,826

[22] Filed: Nov. 25, 1988

Related U.S. Application Data

[60] Division of Ser. No. 180,876, Apr. 13, 1988, which is a continuation of Ser. No. 105,076, Sep. 30, 1987, abandoned.

[51] Int. Cl.[4] ..... C22B 21/00

[52] U.S. Cl. ..... 75/68 R; 75/53; 75/58; 75/257

[58] Field of Search ..... 75/53, 58, 68 R, 257

[56] References Cited

U.S. PATENT DOCUMENTS

| | | | |
|---|---|---|---|
| 2,654,670 | 10/1953 | Davis | 75/68 R |
| 2,848,321 | 8/1958 | Molesworth | 75/68 R |
| 3,765,878 | 10/1973 | Bullough | 75/68 R |
| 3,953,202 | 4/1976 | Rasmussen | 75/68 R |
| 4,368,371 | 1/1983 | Dilthey | 148/26 |

*Primary Examiner*—Peter D. Rosenberg

*Attorney, Agent, or Firm*—David L. Hedden

[57] ABSTRACT

This invention relates to powdered flux compositions and their use in purifying molten mixtures of aluminum and silicon before casting. The powdered flux compositions comprise a carbonate, a sodium and hydrogen free fluoride, and amorphous or encapsulated red phosphorus. The major advantage of the powdered flux is that all necessary components needed to purify the molten mixtures of aluminum and silicon and refine the silicon particles are together in one package, and purification can be carried out in one step.

11 Claims, No Drawings

PROCESS FOR TREATING MOLTEN ALUMINUM ALLOY WITH POWDERED FLUX

This application is a division of application No. 180,876, filed Apr. 13, 1988 allowed which is a continuation of application No. 105,076 filed on Sept. 30, 1987, now abandoned.

TECHNICAL FIELD

This invention relates to a powdered flux particularly useful for treating eutectic and hyper-eutectic aluminum-silicon alloys, and a process for using the powdered flux to treat such alloys. The powdered flux comprises a non hygroscopic carbonate, a sodium and hydrogen free fluoride, and amorphous or encapsulated red phosphorus. Preferably the powdered flux also contains hexachlorethane or paradichlorobenzene as a degasser.

BACKGROUND OF THE INVENTION

It is known to prepare castings from hyper-eutectic aluminum-silicon alloys. Such alloys have from 12.5 to 25.0 percent by weight of silicon and have better strength and ductility than those made purely from aluminum. Consequently, they exhibit better wear resistance than those with lower silicon content. The exceptional wear resistance of the alloys make them suitable for casting heavy duty parts such as automotive engines and pistons. Castings from such alloys are prepared by conventional means by pouring a molten alloy mixture into a core or pattern mold and allowing it to harden. The casting is then removed.

If the castings are to be acceptable they must not contain significant defects in the grain of the casting. Such defects result from impurities in the aluminum-silicon alloy such as hydrogen and oxides. They also result because the primary silicon particles may agglomerate with the result that they enlarge and are not uniformly distributed in the casting.

These defects in the castings can cause the casting to be brittle, and to have weak and strong areas in the grain. Consequently, the castings may chip or break during machining. Reduced machine tool life and down time are also likely to result.

Therefore, it is important to reduce or eliminate impurities and refine primary silicon particles in the molten aluminum alloy in order to enhance the physical properties and machinability of the castings.

Generally, impurities such as those mentioned, are removed from the aluminum-silicon alloy in separate steps. Usually the hydrogen gas is removed followed by the removal of oxide impurities. Then the silicon is refined with phosphorus to prevent it from agglomerating.

The standard method is time consuming and often inefficient. It would be more efficient to reduce the steps involved.

SUMMARY OF THE INVENTION

This invention relates to a powdered flux used for treating mixtures of molten aluminum and silicon comprising:

(a) from 1 to 10 weight percent of a non hygroscopic carbonate;

(b) from 1 to 25 weight percent of a sodium and hydrogen free fluoride; and (c) red phosphorus selected from the group consisting of amorphous red phosphorus, encapsulated red phosphorus, and mixtures thereof;

wherein said weight percent is based upon the total weight of the powdered flux, and the red phosphorous is used in an amount effective to produce alloys having acceptable primary silicon particles. The primary silicon particles are acceptable if at least 90 percent of such particles have a particle size of less than 1.0 millimeters in diameter after treatment with the powdered flux, preferably 60 microns or less. The powdered flux also preferably contains from 70 to 90 weight percent of hexachloroethane.

The advantage of this powdered flux is that it is a powder and can be uniformly distributed in the molten aluminum-silicon alloy. It also contains all of the major components of the flux in one package and thus allows the molten aluminum-silicon alloy to be purified and refined in one step. A preferred flux composition is one which is free or essentially free of sodium and calcium.

The invention also relates to a process for treating a molten aluminum-silicon alloy which comprises injecting a powdered flux dispersed in a carrier gas into the molten aluminum-silicon alloy in an amount effective for producing an acceptable casting from the alloy.

The major advantage of the process is that the powdered flux can be dispersed uniformly into the molten alloy in one step.

BEST MODE AND OTHER MODES FOR CARRYING OUT THE INVENTION

Non hygroscopic carbonates are known and function to improve flowability and prevent the powdered flux from agglomerating during the treatment process. The carbonates used herein are preferably sodium and calcium free such as $MgCO_3$. They are used in amounts of from 1 to 10, percent by weight, preferably from 2 to 5 percent by weight, said weight based upon the total weight of the powdered flux.

The function of the sodium and hydrogen free fluoride is to de-wet oxide impurities in the molten mixture of aluminum and silicon so they can float to the surface of the mixture of molten aluminum and silicon where they are removed. They also assist in hydrogen removal. The sodium and hydrogen free fluorides may contain other elements such as silicon, boron, titanium, and aluminum. Representative examples include as fluorides such as KF, $MgF_2$, $AlF_3$, and $K_3AlF_6$. Compounds containing both potassium and fluorine are preferred. Particularly preferred is $K_2SiF_6$. The fluorides are used in amounts of 1 to 25 percent by weight based upon the total weight of the powdered flux, preferably from 7 to 10 percent by weight.

The other required component of the powdered flux is amorphous or encapsulated red phosphorous. Encapsulated red phosphorous is red phosphorous coated with a synthetic resin which makes it safer to handle. One source of encapsulated red phosphorus is Albright & Wilson Chemical Company in the United Kingdom. Its function in the powdered flux is to refine the silicon particles in the mixture of molten aluminum and silicon so that large primary silicon particles are not formed which are not uniformly distributed throughout the alloy. The amount of red phosphorus used in the powdered flux is an amount sufficient to produce an alloy which can be used to produce acceptable casting. Generally, this amount will be from 1 to 15 weight percent based upon the weight of the powdered flux, preferably from 1 to 7 weight percent.

Preferably the powdered flux contains a powdered degasser such as hexachloroethane or paradichlorobenzene. The basic function of the hexachloroethane or paradichlorobenzene is to remove dissolved hydrogen from the molten mixture of aluminum and silicon. Dissolved hydrogen is an impurity which can result in the formation of pinholes in the casting produced with the alloy. Another function of the degasser is to remove calcium and sodium. Powdered degassers are used in an amount of 70 to 90 percent by weight, based upon the weight of the powdered flux, preferably from 80 to 85 percent by weight.

The particle size of the powdered flux is also significant. If the particle size is too large, it will be more difficult to uniformly distribute the powdered flux into the molten mixture of aluminum and silicon. Generally, the powdered flux is such that at least 80 weight percent, preferably 90 to 95, weight percent of the particles of each component will pass through a 50 mesh screen and be retained on a 200 mesh screen.

The powdered flux is dispersed in a carrier gas such as nitrogen, argon, helium, or chlorine by means well known in the art. Chlorine is used as the carrier gas if a powdered degasser is not used because chlorine acts as a degasser. The dispersion is fed through a lance such as a silicon carbide or refractory lance, into the molten mixture of aluminum and silicon. In the molten mixture impurity removal and silicon refinement occur simultaneously.

The amount of powdered flux needed to treat the molten mixture of aluminum and silicon will depend upon the degree of impurities. However, it has been found that generally the dispersion of powdered flux should be uniformly metered into the molten mixture at a rate of from 0.15 to 0.5 weight percent based upon the weight percent of the molten mixtures, preferably 0.20 to 0.30 weight percent.

The powdered fluxes are particularly useful for treating molten eutectic and hypoeutectic mixtures of aluminum and silicon having from 12.5 percent by weight to 25 percent by weight of silicon, based upon the total weight of the molten mixture.

EXAMPLES

The examples which follow will illustrate specific embodiments of the invention, but should not be construed to limit the scope of this invention.

EXAMPLE 1

This example illustrates the preparation of a flux powder. A powdered flux was prepared by mixing the following components in the amounts designated. The weight percent of the amount of particles for each component which passed through a 50 mesh screen and was retained on a 200 mesh screen is also given.

| Component | Amount (% bw) | % Through[2] 50 Mesh | % Retained[2] on 200 Mesh |
|---|---|---|---|
| hexachloroethane | 83 | 75 | 95 |
| Ultra Carb US (magnesium-carbonate) | 2 | 100 | 0 |
| encapsulated red phosphorous* | 5 | 90 | 95 |
| $K_2SiF_6$ | 10 | 80 | 100 |

[1]Red phosphorus particles encapsulated in a synthetic resin, sold by Albright and Wilson of the United Kingdom.
[2]Based upon manufacturers specifications.

EXAMPLE 2

Example 2 will illustrate how a molten mixture of aluminum and silicon was treated with the powdered flux of Example 1.

A one ton aluminum alloy ingot containing approximately 12.5 weight percent of silicon (the remainder being most aluminum and typical impurities found in such an ingot) was heated to a temperature of 730° C. The flux composition was fed into the molten alloy through a silicon carbide lance at a rate of 500 grams per minute by dispersing the powdered flux in nitrogen. The molten alloy was treated for approximately 12 minutes.

Table I shows the amount of various impurities before and after the treatment.

TABLE I

| Impurity | Amount Before | Amount After |
|---|---|---|
| hydrogen | 0.35 cc/100 cc | 0.1 cc/100 cc |
| sodium | 105 ppm | >1 ppm |
| calcium | 158 ppm | 2 ppm |

Table I shows a reduction of all impurities measured. As can be seen from this example, treatment times were also low, only 12 minutes in this example. Typically treatment times are from 10–15 minutes. The removal of these impurities is important because hydrogen is known to cause pinhole porosity while sodium and calcium neutralize the effectiveness of red phosphorus which refines the primary silicon particles.

I claim:

1. A process for treating a molten mixture of aluminum and silicon to remove impurities and enhance grain refinement comprising injecting a powdered flux, dispersed in a carrier gas, into a molten mixture of aluminum and silicon in an amount and for a time effective to produce an acceptable aluminum alloy casting, wherein said powdered flux comprises (a) from 1 to 10 weight percent of a non hygroscopic carbonate;

(b) from 1 to 25 weight percent of a sodium and hydrogen free fluoride; and (c) red phosphorus selected from the group consisting of amorphous red phosphorous, encapsulated red phosphorus, and mixtures thereof;

wherein said weight percent is based upon the total weight of the powdered flux and the red phosphorus is used in an amount effective to produce alloys having an acceptable primary silicon particles.

2. The process of claim 1 wherein aluminum-silicon alloy to be purified is a eutectic or hypereutectic alloy.

3. The process of claim 1 wherein the carrier gas is chlorine.

4. The process of claim 1 where the carrier gas is nitrogen.

5. The process of claim 2 wherein the powdered flux also contains from 70 to 90 weight percent of a powdered degasser.

6. The process of claim 2 wherein the phosphorus of the powdered flux is encapsulated red phosphorus.

7. The process of claim 2 wherein the particle size for each component of the powdered flux is such that at least 80 weight percent will be passed through a 50 mesh screen and be retained on a 200 mesh screen.

8. The process of claim 2 wherein the powdered flux is is essentially sodium free.

9. The process of claim 2 wherein the fluoride of the powdered flux is used in an amount of 7 to 10 weight percent.

10. The process of claim 1 wherein the red phosphorous of the powdered flux is used in an amount of 1 to 7 weight percent based upon the total weight of the powdered flux.

11. The process of claim 1 wherein the fluoride of the powdered flux is $K_2SiF_6$.

* * * * *